United States Patent [19]

Casady

[11] 4,355,746

[45] Oct. 26, 1982

[54] GOLF BAG HOLDER FOR USE WITH GOLF CARS

[75] Inventor: Dale D. Casady, Salt Lake County, Utah

[73] Assignee: Bailey & Sons Company, Salt Lake City, Utah

[21] Appl. No.: 294,721

[22] Filed: Aug. 20, 1981

[51] Int. Cl.[3] ..... A47F 7/00

[52] U.S. Cl. ..... 224/274; 224/42.45 R; 211/100; 248/96

[58] Field of Search ..... 224/274, 42.45 R, 282, 224/42.03 B; 280/DIG. 5, 769; 211/100; 248/96, 434, 435, 168

[56] References Cited

U.S. PATENT DOCUMENTS 2,706,049 4/1955 Andrews ..... 224/42.45 R 2,967,624 1/1961 Spellman ..... 211/100

3,888,324 6/1975 Kossow ..... 280/DIG. 5

4,289,243 9/1981 Arbuzoff ..... 211/100 X

*Primary Examiner*—Steven M. Pollard

*Attorney, Agent, or Firm*—Mallinckrodt & Mallinckrodt

[57] ABSTRACT

A golf bag holder for use with golf cars includes a frame having a plurality of arms pivotally mounted thereto. The holder is secured to a golf car so that a golf bag may be attached to each arm and be held in a position where the bottom of the bag rests in or on the car while the top of the bag from which the clubs extend is held at an angle at the back of the car to provide easy access to the clubs. The holder preferably has four arms so that four bags may be held on a normal golf car. The arms have an unused position which keeps them out of the way when no golf bag is being held.

6 Claims, 4 Drawing Figures

GOLF BAG HOLDER FOR USE WITH GOLF CARS

BACKGROUND OF THE INVENTION

1. Field

This invention is in the field of devices for holding golf bags on golf cars (or "carts" as they are sometimes called) as the cars are driven around a golf course during a game of golf. The invention is particularly suited to converting the normal golf cars, which generally have a holder for holding two golf bags, to a car which can hold four golf bags.

2. State of the Art

Most golf cars as manufactured and in use today are built to carry two golfers and to hold two gold bags, one for each golfer. These holders generally consist of two brackets secured to the car such that a bag is placed in upright position against each bracket and is strapped in place against the bracket. It often happens, when more than two people are playing golf, e.g. either a threesome or a foursome, that they will not want to rent two cars for use during the game but would prefer to use only a single car. In such instance, it would be advantageous to be able to carry all four golf bags on the one car. There are currently available holder adapter kits for use with certain golf cars, which provide for holding on the car four rather than two bags. Such holders are add-ons and are secured to the back end of the car to provide room for holding two additional bags. However, these add-on holders usually hang down below the car body and can hit the ground on hilly terrain. As such, they lack practicality. In addition, they are used in conjunction with the normal strap arrangement for holding only two bags, which makes access to a particular bag difficult. Further, an important consideration for golf courses using such adapters is that, since they are attached to the back of the cars, they increase the length of the cars. This means that fewer cars will fit into a garage of any given size.

There remains the need for an effective and convenient golf bag holder for a golf cart which may be used to carry as many as four golf bags and to have such bags arranged for easy access by all four players, as well as not adding any additional length to the golf car itself and not extending below the body of the golf car.

SUMMARY OF THE INVENTION

According to the invention, a golf bag holder for attachment to a golf car includes a frame having a plurality of arms pivotally mounted thereon. Each arm has means for attaching a golf bag, such as a hook upon which the normal golf bag ring may be placed, and each arm may be held in an upright, unused, out-of-the-way position when not holding a golf bag. This is preferably accomplished by resiliently mounting each arm so that it is normally urged to the out-of-the-way position. For use, the arm is pulled downwardly so that a bag can be attached thereto. It has a stop to limit downward travel of the arm at a position at which it holds the golf bag at an angle outwardly from the golf car and with the bottom of the bag resting on the car. The arms are free to move upwardly with the golf bag, thereby preventing the ring from coming off the hook whenever the car hits a bump. Such movement is improved by the preferred resilient mounting of the arms, it being realized that the construction may be such that the arms must be manually moved upwardly.

The golf bag holder of the invention may be built as a normal two bag holder, in which case there will, of course, be only two arms provided. Even so, the holder provides advantages over previously known holders in ease use by reasons of the elimination of straps and in the holding of the bags at an angle to allow easier access to the clubs. It is preferred, however, that the holder be made as previously indicated to hold four golf bags, in which case it will have four arms. When constructed and used for four bags, the bottoms of the two outside bags will normally rest on the rear fenders, respectively, of the golf car, and it is preferred to provide U-shaped brackets to hold such bag bottoms from lateral travel. It should be understood that, as constructed to accomodated four bags, the bottom may be used for any lesser number of bags.

THE DRAWINGS

In the accompanying drawings, which represent the best mode presently contemplated for carrying out the invention:

FIG. 1 is a perspective view of the rear end of a golf car having the holder of the invention secured thereto in unused condition;

FIG. 2, a fragmentary side elevation showing the rear of the golf car with the holder attached thereto as in FIG. 1, but in use with one golf bag in held position;

FIG. 3 a horizontal section taken on the line 3—3 of FIG. 1, showing the holder largely in top plan as removed from the golf car; and FIG. 4, a fragmentary vertical section taken on the line 4—4 of FIG. 3 and drawn to a larger scale, the bag holding position of the arm concerned in being shown in phantom.

DETAILED DESCRIPTION OF THE ILLUSTRATED EMBODIMENT

Figure 1:
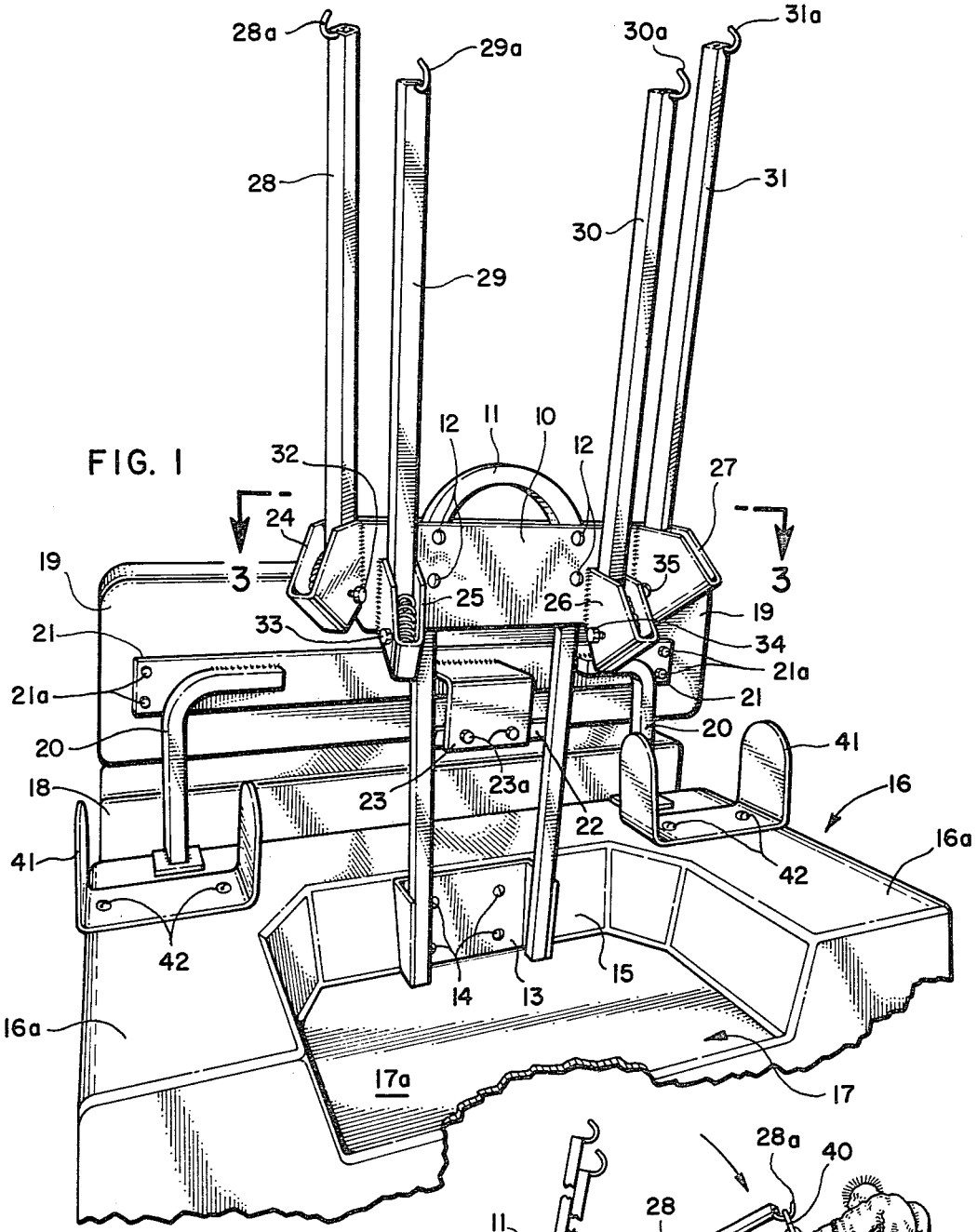
Figure 2:
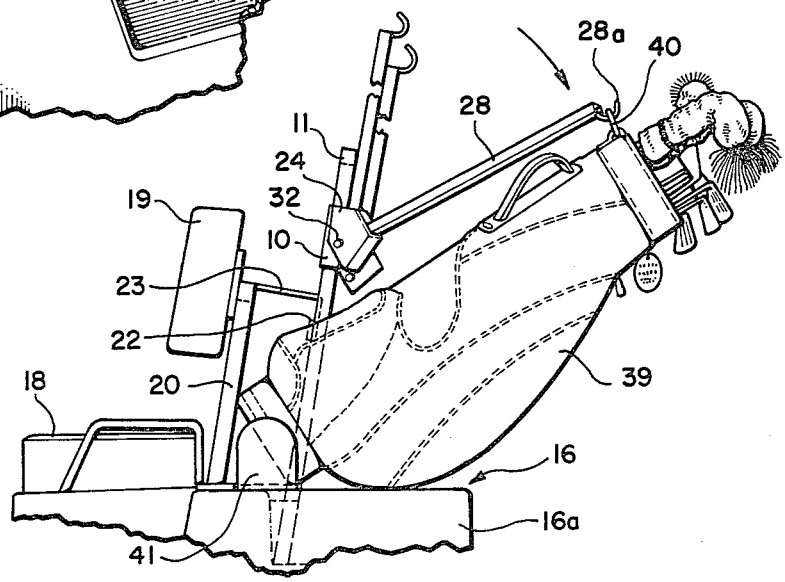
Figure 3:
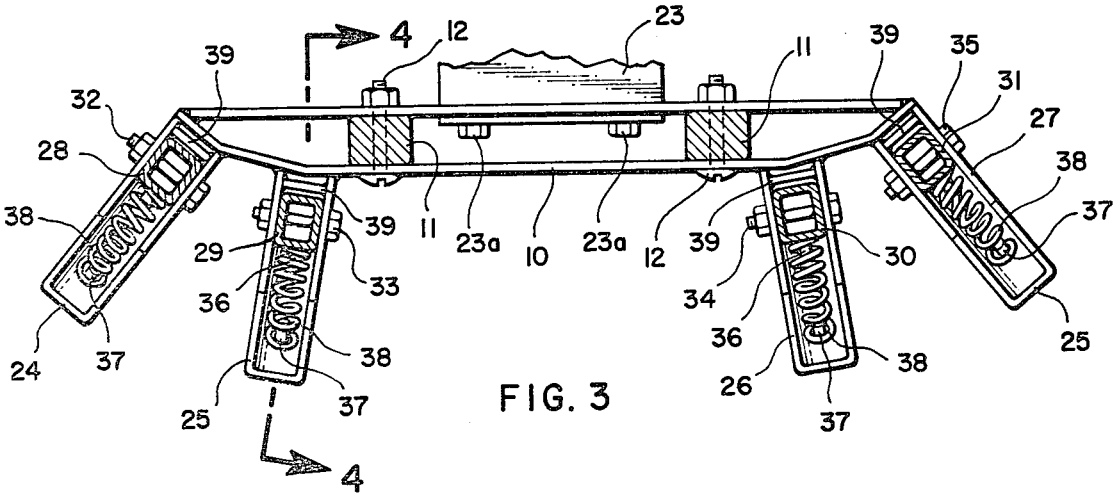

In the presently preferred embodiment of the invention, a transversely extending, main holder frame 10, see particularly FIGS. 1 and 3, is secured to an upstanding U-shaped, supporting frame 11 such as by bolts 12. Supporting frame 11 is secured, as by welding, to a mounting bracket 13, which is secured, as by bolts 14, to an upstanding wall 15 in the rear portion of a usual golf car body 16. Such golf car normally has fenders **16*a* on either side of and extending rearwardly of the wall 15, substantially as shown, so as to define a well 17 opening at the rear of the car and provided with a floor 17*a* for receiving and supporting the bottoms of two golf bags when placed in normal manner thereon as would be the case if the usual bracket and strap holder-were used. Wall 15 to which the holder of the invention is secured is the rear wall in the usual golf car body, which defines the front of well 17. The usual golf car also has a seat bottom 18 located ahead of such well and a seat back 19 associated with seat bottom 18, FIGS. 1 and 2**.

The Seat back 19 is supported on the car body by upstanding supports 20 secured to the car body on opposite sides thereof and secured to a back support 21 at opposite ends thereof, which is itself fastened, as by screws **21*a*, to the rear face of seat back 19. A cross-bar 22 extends between opposite legs of U-shaped frame 11, and a bracket 23 is secured thereto and to the back seat support 21, as by bolts 23*a* and welding, respectively. This further secures frame 11 to the car. As illustrated in FIG. 3, frame 10 of the holder extends around both sides of U-shaped frame 11. Such construction is not necessary, but increases the strength of frame 10** and the stability of the entire holder when under load during movement of the golf car.

Figure 4:
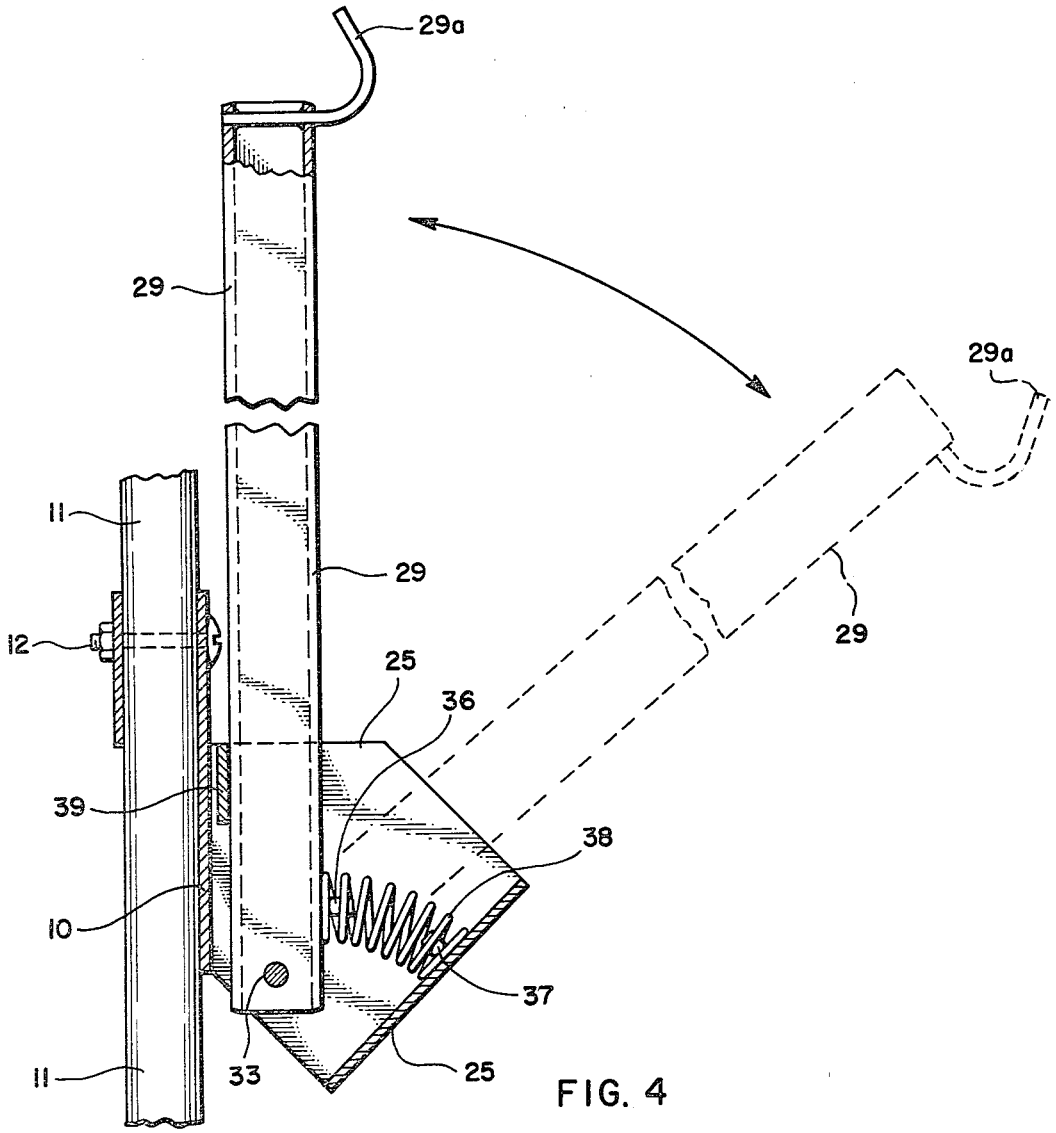

Secured to frame 10 are four brackets 24, 25, 26 and 27. Arms 28, 29, 30, and 31 are pivotally mounted in brackets 24, 25, 26 and 27 respectively by bolts 32, 33, 34, and 35. Each arm has a pin 36 secured thereto near its pivot point, FIG. 4, which is alligned with a pin 37 secured in each of the brackets. A spring 38 is inserted between each arm and bracket and is held in place by pins 36 and 37. Operation of the arm will be described with reference to FIG. 4 which shows arm 29. The operation will be the same, however, for each arm. With spring 38 in place, arm 29 is urged to its upright position as shown in solid lines of FIG. 4, and as shown in FIG. 1. A stop 39 is preferably welded in place in bracket 25 to keep arm 29 from hitting frame 10 when in its upright position. A similar stop 39 is provided in each of the other brackets 24, 26, and 27 respectively as shown in FIG. 3. When pivoted about bolt 33, arm 27 is moved downwardly to the position shown in broken lines in FIG. 4. Spring 38 is compressed and pins 36 and 37 abut to prevent deformation of spring 38 which might otherwise occur if arm 27 was supported in its pivoted position entirely by compressed spring 38.

In use, when a golf bag 39 is to be held, an arm, such as arm 28, FIG. 2, is pulled down to its pivoted position and the ring 40, usually provided on a golf bag, is hooked onto a hook **28*a* provided for that purpose at the end of arm 28. Similar hooks are provided at the end of each of the other arms 29, 30, and 31 and are designated 29*a*, 30*a*, and 31*a*** respectively.

When being held, the bottom of the held golf bags rest on the car. Thus, where the middle arms 29 and 30 are used, the bottom of the bags held by those arms will rest in well 17 as is usually the case and will generally also rest against well wall 15 since the bags are held at an angle. When the outside arms 28 or 31 are used, as shown in FIG. 2, the bottom of the bags will rest on fenders 16 of the car and generally against seat upright support 20, since these bags are also held at an angle, as shown. To prevent lateral movement of the bags from side to side on the fenders, generally U-shaped brackets 41 are secured to fenders 16, such as by bolts 42.

Brackets 25 and 26 are positioned on frame 10 such that arms 29 and 30 are directly in line with the desired position of the golf bags to be held by such arms. Thus, these arms may move down directly toward the back of the car. Brackets 24 and 27 are positioned such that arms 28 and 31 move downwardly toward the side of the car so that in down positon the ends of such arms and the hooks **28*a* and 31*a* are in line with the bags to be held by such hooks when the bottom of the bags are in brackets 41. In this way the bags extend directly backwards over the fender 16** of the car. Thus, when four bags are being held, all extend and are held parallel to one another, and the end of the bags from which the clubs extend are at the rear of the car for easy access to the clubs. Access is facilitated by holding the bags at an angle rather than straight up and down as is done in conventional holders.

While the arms need not be made resilient by use of springs 38 or by other means, it is preferred because the resilience of the arms which urge them toward upright position not only automatically keeps the unused arms in upright position out of the way, but causes them to rise and fall with the golf bags being held so, as the car moves, the rings held by the hooks at the end of the arms are kept hooked without using a type of hook that completely closes the ring. Without the resilience of the arms, the rings will tend to come off the hooks if the bags are bounced upwardly by the car hiting a bump or traversing rough or uneven terrain unless they are held on the hook by some type of latch. Also, the resilience of the arms tend to moderate the jouncing of the bags that would occur if the arms were free to merely fall against their stops after being bounced upwardly. Of course, the arms could be provided with a closing hook which would hold the ring securely (this could be done regardless of whether the arms are resiliently mounted) and the arms could each have a catch to hold then in upright, unused position without the resilient means. Other means of securing the golf bag to an arm could be used such as a strap or a hoop to encircle the bag and secure it to an arm.

The strength of the springs used, or other means used to make the arms resilient should be such that the arms can be easily pulled down by the average person for attachment of the golf bag, but strong enough to hold the arm in substantially upright position out of the way when not in use. It has been found that generally the preferred spring strength is such that the golf bag is not supported by the strength of the spring, but rather by the brackets holding the arms.

Whereas this invention is here illustrated and described with specific reference to an embodiment thereof presently contemplated as the best mode of carrying out such invention in actual practice, it is to be understood that various changes maybe made in adapting the invention to different embodiments without departing from the broader inventive concepts disclosed herein and comprehended by the claims that follow.

I claim:

1. A golf bag holder for use with golf cars, comprising a frame; a plurality of arms pivotally mounted to said frame; means for attaching a golf bag to each arm so that the end of the bag from which the clubs extend is supported by an arm while the other end of the bag rests on the car; stop means to stop travel of each arm about its pivot in one direction at the preferred point for supporting the golf bag and in the other direction at a point at which the arm can rest out of the way in an unused positon; means to hold an arm in its unused positon when not holding a golf bag; and means for securing said frame to a golf car.

2. A golf bag holder according to claim 1, wherein the means to hold the arm in its unused position is means to resiliently bias said arm to that position when it is not holding a golf bag.

3. A golf bag holder according to claim 2, wherein each arm is pivotally mounted to the frame by being pivotally mounted in a bracket secured to the frame, wherein the stop means to stop travel at the preferred point for supporting the golf bag is a stop provided by the bracket, and wherein the means to resiliently bias the arm is a spring positioned between the arm and a portion of the bracket in which the arm is pivoted.

4. A golf bag holder according to claim 3, wherein there are four arms provided, each adapted to hold a golf bag.

5. A golf bag holder according to claim 4, wherein the holder is adapted to be attached to a golf car having two rear fenders and a well formed between the fenders, wherein two of the arms are adapted to hold golf bags so that the bottoms of the bags rest in the wells and two of the arms are adapted to hold golf bags so that the bottoms of the bags rest one on each fender, and wherein there is additionally provided a U-shaped bracket on each of said rear fenders for holding the bottom of a golf bag placed therein from lateral movement off the sides of the fenders.

6. A golf bag holder according to claim 1 wherein there are four arms provided, each adapted to hold a golf bag, wherein the holder is adapted to be attached to a golf car having two rear fenders and a well formed between the fenders, wherein two of the arms are adapted to hold golf bags so that the bottoms of the bags rest in the wells and two of the arms are adapted to hold golf bags so that the bottoms of the bags rest one on each fender, and wherein there is additionally provided a U-shaped bracket on each of said rear fenders for holding the bottom of a golf bag placed therein from lateral movement off the sides of the fenders.

* * * * *